United States Patent [19]

Legille et al.

[11] Patent Number: 4,889,008

[45] Date of Patent: Dec. 26, 1989

[54] APPARATUS FOR DRIVING AN OSCILLATING SPOUT

[75] Inventors: Edouard Legille, Luxembourg; Emile Lonardi, Bascharage, both of Luxembourg

[73] Assignee: Paul Wurth S.A., Luxembourg, Luxembourg

[21] Appl. No.: 814,326

[22] Filed: Dec. 30, 1985

Related U.S. Application Data

[63] Continuation of Ser. No. 504,464, Jun. 15, 1983, abandoned.

[30] Foreign Application Priority Data

Jun. 24, 1982 [LU] Luxembourg ..... 84225

[51] Int. Cl.[4] ..... G05G 1/04; F16D 3/00

[52] U.S. Cl. ..... 74/520; 403/58; 74/99 R

[58] Field of Search ..... 74/520, 88–106, 74/96, 97, 99 R, 99 A; 403/57, 58

[56] References Cited

U.S. PATENT DOCUMENTS

| | | | |
|---|---|---|---|
| 1,830,303 | 11/1931 | Turner | 403/57 |
| 2,027,499 | 1/1936 | Tully | 403/58 |
| 2,038,697 | 4/1936 | Winslow | 403/57 |
| 2,605,118 | 7/1952 | Booth et al. | 403/58 |
| 2,796,619 | 6/1957 | Hammer | 403/58 |
| 3,442,478 | 5/1969 | Parapetti | 403/58 |
| 3,939,718 | 2/1976 | Banks | 74/99 R |
| 4,182,198 | 1/1980 | Dartnell | 74/513 |
| 4,271,711 | 6/1981 | Vavra | 74/99 R |
| 4,272,972 | 6/1981 | James | 403/58 |
| 4,541,818 | 9/1985 | Olschewski et al. | 403/57 |
| 4,559,839 | 12/1985 | Legille et al. | 74/520 |

FOREIGN PATENT DOCUMENTS

| | | | |
|---|---|---|---|
| 512718 | 7/1952 | Belgium | 74/96 |
| 1023268 | 1/1958 | Fed. Rep. of Germany | 74/96 |
| 1217921 | 5/1960 | France | 74/96 |

*Primary Examiner*—Vinh T. Luong

*Attorney, Agent, or Firm*—Fishman, Dionne & Cantor

[57] ABSTRACT

A driving apparatus for an oscillating spout is presented which includes a control mechanism which directs a control arm to perform the movement required by the spout and a transmission device which acts to transmit the control arm movement and reproduce it as spout movement. The control mechanism consists of a driving rod pivotally connected to an intermediate lever arm and a novel universal joint connecting the lever arm to the control arm. The universal joint enables the spout to be moved in and out of a vertical orientation by prohibiting the components of the control mechanism from becoming axially locked in a 180° angle.

8 Claims, 2 Drawing Sheets

APPARATUS FOR DRIVING AN OSCILLATING SPOUT

This application is a continuation of application Ser. No. 504,464 filed June 15, 1983, now abandoned.

BACKGROUND OF THE INVENTION

This invention relates to the field of drive means for oscillating spouts. More particularly, this invention relates to a new and improved apparatus for driving an oscillating spout for a shaft furnace, the spout being capable of pivoting about two orthogonal axes under the action of a pivoting control arm.

Apparatus of this general type has been described in French patent application No. 80 13 890, corresponding to U.S. Pat. No. 4,306,827 which relates to an apparatus for the distribution of charge material in a blast furnace. U.S. Pat. No. 4,306,827 discloses a preferred embodiment wherein the control arm is mounted outside the furnace head. A transmission device which translates the movement of the control arm to the spout is constructed so that the distribution spout and the control arm are always parallel to each other. To distribute the charge material in a circular trajectory, the control arm turns about a vertical axis parallel to the vertical axis of the furnace about which the spout is required to turn. In order to modify the angle of inclination of the spout which, in turn, modifies the radius of the circular trajectory in which the charge material is deposited, a change is made to the angle of inclination of the control arm in relation to its central axis of rotation. An intermediate lever together with the control arm form a rotating hinge with a variable angle of opening (i.e, the included angle). It is this angle of opening which determines the angle of inclination of the control arm and that of the spout in relation to the vertical axis of the furnace.

Unfortunately, despite its simple design, the driving device for the control arm of U.S. Pat. No. 4,306,827 does not allow the distribution spout to be oriented vertically (i.e., it does not enable the charging material to be deposited in the center of the charging surface). Vertical orientation of the spout can only be achieved by positioning the hinge formed by the intermediate lever and the control arm to form an angle of 180° such that the driving rod, the intermediate lever and the control arm are all aligned with one another. Although it is possible to accomplish such an alignment, it is thereafter impossible to move the elements out of this vertical positioning in a controlled manner, since a force exerted on the driving rod, no matter how great, cannot effect controlled modification of the hinge angle once the angle has reach 180 degrees. Only a force directed from the side would be able to unlock the vertical orientation.

SUMMARY OF THE INVENTION

The above-discussed and other problems of the prior art are overcome or alleviated by the driving apparatus for oscillating spouts of the present invention. In accordance with the present invention, a driving device is presented in which the distribution spout can be oriented vertically without remaining locked in that position.

The present invention provides an apparatus for driving an oscillating spout capable of pivoting about two orthogonal axes under the action of a pivoting control arm having the same degrees of liberty as the spout. An embodiment of the present invention includes a control mechanism which directs the control arm to perform the movement required by the spout and a transmission device which acts to transmit the control arm movement to the spout to reproduce it as spout movement, and vice versa.

The control mechanism of the present invention consists of a driving rod capable of both turning about its longitudinal axis and undergoing axial displacement. The driving rod is connected to and is driven by two independent driving means to effect these two movements. The end of the driving rod is pivotally attached to an intermediate lever which is pivotally attached in turn, by a universal joint to the end of the control arm. The arrangement of the rod, lever and arm is such that a longitudinal displacement of the driving rod changes the angle of inclination of the control arm in relation to a central axis coaxial with the driving rod while a rotational movement by the driving rod creates a conical precessional movement of the control arm about the central axis.

Unlike the prior art device, the universal joint of the present invention has a novel construction wherein the control arm and the intermediate lever will not assume a position in which their longitudinal axes are vertically aligned with each and with the longitudinal axis of the driving rod. In a preferred embodiment, the novel universal joint comprises a connecting block connected by two journals to the intermediate lever and provided with a bore in which the head of the control arm is coaxially engaged and connected to the block. This structure is such that the axes of the bore and of the journals are orthogonal yet offset in relation to one another.

The structural design of the present invention enables the spout to be oriented vertically (i.e., permit charge material to be deposited in the center of the charging surface) by moving the driving rod longitudinally so that the hinge (intermediate lever and control arm) can be fully opened. In this position, the hinge has an included angle which is less than the 180° exhibited in the prior art. Moreover, the axis of the journals remains on one side of the central axis so that the hinge can (i.e., the included angle reduced) close up again by a longitudinal movement of the driving rod. Thus, the locking problem of the prior art is solved by the novel structure of the present invention without the need for application of any external side forces.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 3:
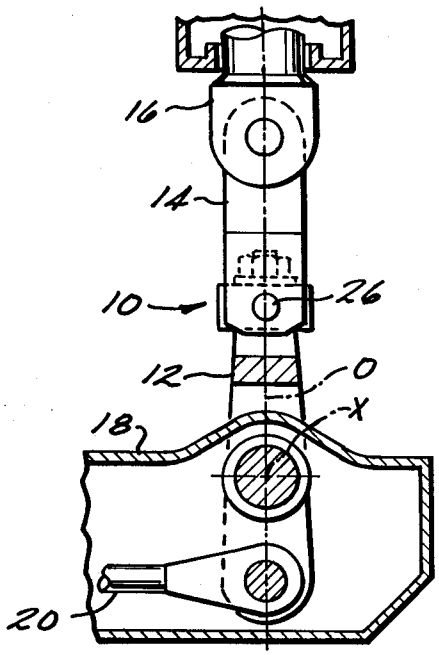
FIG. 3 (PRIOR ART)
FIG. 3 is a front elevation view of the drive means of FIG. 1 fully opened so that the distribution spout is vertically oriented.
Figure 1:
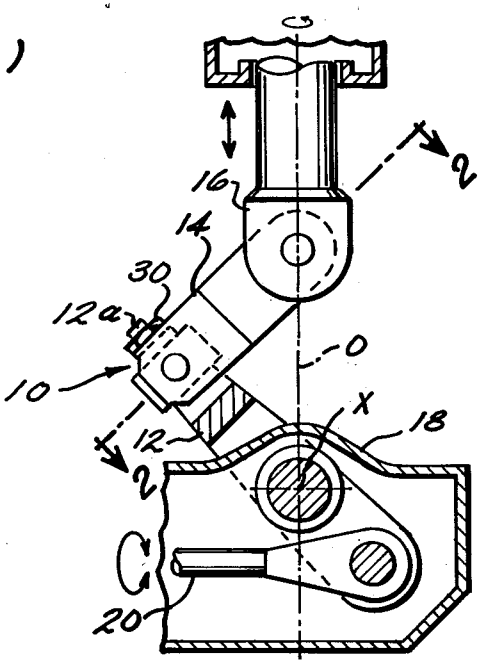
FIG. 1 (PRIOR ART)
FIG. 1 is a front elevation view of a drive means in accordance with the prior art.
Figure 2:
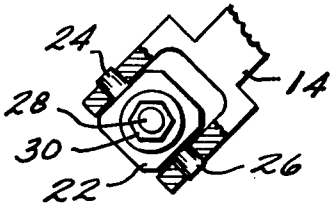
FIG. 2 (PRIOR ART)
FIG. 2 is a sectional view along line II—II of FIG. 1.

Referring to FIGS. 1–3, a hinge 10 having a variable (i.e., adjustable) angle of opening and capable of rotating about a vertical axis O is shown. This hinge consists of a control arm 12 which pivots about an axis X perpendicular to the plane of the drawing, and of an intermediate lever 14.

The control arm 12 is connected by means of a suitable transmission mechanism to a distribution spout (not shown in the drawings). This transmission mechanism is preferably of the type disclosed in European patent application No. 82 101 943 corresponding to U.S. Pat. No. 4,525,120 and consists of a transmission bar 20 actuated by the pivoting control arm 12 and performing its cycle of movements inside a tight fork 18 capable of pivoting about its longitudinal axis.

The intermediate lever 14 is connected to a driving rod 16 actuated by suitable driving means (not shown) and which are capable of causing the rod 16 to turn about the axis O and/or of displacing it longitudinally along the axis O. These movements cause the rotation of the hinge 10 about the axis O and/or a modification of its angle of opening (i.e., the included angle between arm 12 and lever 14).

The conversion of this conical precession movement of the control arm 12 about the axis O into a corresponding movement of distribution spout is explained in greater detail in the U.S. Pat. Nos. 4,306,827 and 4,525,120 previously referred to, the entire disclosures of which are incorporated herein by reference and to which reference should be made for these additional explanations.

Control arm 12 and lever 14 are connected by a universal joint which enables the angle of opening of hinge 10 to be changed by a translational, i.e., longitudinal, movement of the driving rod 16 as well as by relative pivoting movement between the control arm 12 and the lever 14 about the longitudinal axis of the control arm 12. FIG. 3 illustrates an embodiment of a prior art universal joint of this kind. In this embodiment, the lower end of the intermediate lever 14 is in the form of a bifurcated or fork member wherein connecting block 22 is connected by two journals 24 and 26 to the two prongs of the fork member of the lever 14. This connecting block 22 can thus pivot about the axis of the journals 24 and 26 in relation to the lever 14; and lever 14 can similarly pivot about the connecting block 22.

Still referring to FIG. 3, connecting block 22 is also provided with a central bore or passage 28, the axis of which is perpendicular to and intersects the axis of the journals 24 and 26. A cylindrical extension **12*a* on arm 12 extends through passage 28 and is rotatably mounted in passage 28. Thus, extension 12*a* on the upper end of the control arm 12 permits relative rotation to take place between the cylindrical extension 12*a* and the passage 28 and block 22. To secure the control arm 12 in position in the connecting block 22, a screw threading can be provided on the end of the extension 12*a* which is fitted with a fastener, such as that shown at 30**.

In the prior art configuration of FIGS. 1–3, to orientate the distribution spout fully vertically, the driving rod 16 must be raised until the hinge 10 is completely open (i.e., 180°) and occupies the position shown in FIG. 3, i.e., wherein the driving rod 16, the intermediate lever 14 and the control arm 12 are aligned coaxially on the axis O. As discussed previously, in the prior art, it has been impossible to return the structure in a controlled manner from the position shown in FIG. 3 to a configuration as shown in FIG. 1 without an external side force. Simply exerting a downward force on the driving rod 16 is not adequate since the components become locked in a 180° position.

Figure 6:
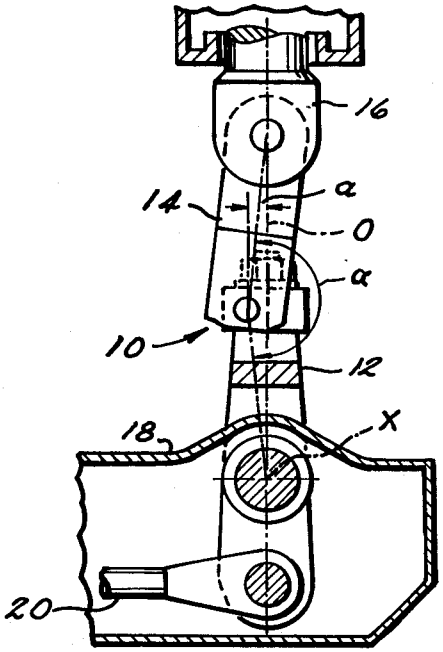
FIG. 6 is a front elevation view of the drive means of FIG. 4 fully opened so that the distribution spout is vertically oriented.
Figure 4:
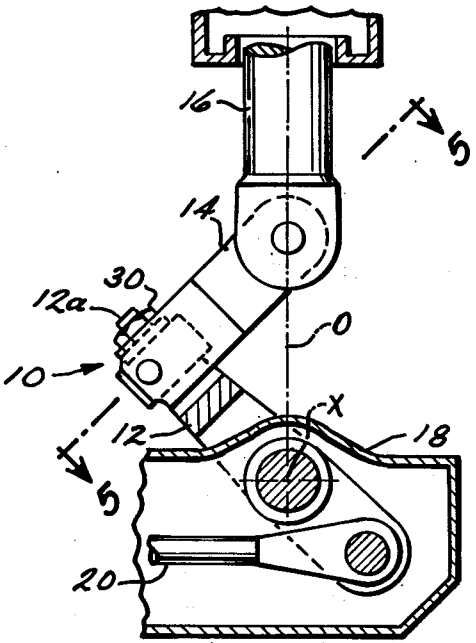
FIG. 4 is a front elevation view of a drive means in accordance with the present invention.
Figure 5:
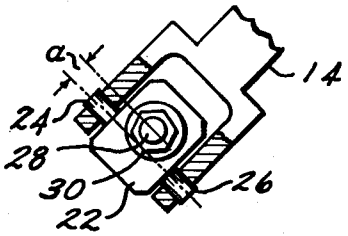
FIG. 5 is a sectional view along line V—V of FIG. 4.

Referring jointly to FIGS. 4, 5 and 6, the novel improvement and control mechanism of the present invention which remedies the above problem is shown. The present invention has a similar design to that described in the prior art except for the structure of the universal joint. The essential structural difference is the way in which the axis of the journals 24 and 26 is offset in relation to the axis of the bore 28 (which corresponds to the longitudinal axis of the control arm 12 as shown in FIG. 5). As seen in FIG. 5, the axis of the journals 24 and 26 is offset by the distance "a" from the axis of bore 28 (and hence from the longitudinal axis of control arm 12).

Referring to FIG. 6, when the spout is positioned vertically (corresponding to a vertical position for arm 12 with the axis of arm 12 aligned with the vertical axis "O"), the axis of the journals 24 and 26 remains at a distance "a" from the axis O. Thus, with the spout in its full vertical position, the angle $\alpha$ of the hinge will be less than 180°. This enables the driving rod 16 to be lowered from the position shown in FIG. 6 to reduce the angle of the hinge 10, i.e., to increase the angle of inclination of the control arm 12 in relation to the axis O and therefore to raise the distributing spout if vertical distribution is not desired.

Thus, a controlled driving means for moving an oscillating spout in and out of a vertical position is achieved without the undesirable locking problem and without the need for external side forces to move the spount from the vertical. The driving means of the present invention is well suited for distributing charge material in a blast or other shaft furnace.

It should be noted that the device of the present invention illustrated by FIGS. 4–6 will not impede the transmission of the movement of the control arm 12 to the distributing spout. Note also that the friction between the cylindrical head **12*a* and the boring 28** can be reduced by the provision of a bearing.

The disclosures of U.S. Pat. Nos. 4,525,120 and 4,306,827 (of which U.S. Pat. No. 4,525,120 is assigned to the assignee hereof) are referenced hereto and incorporated herewith.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for controlling the movement of an oscillating spout comprising;

a driving rod capable of rotation about its longitudinal axis and capable of axial displacement;

an intermediate lever arm having a first end and a second end and connected at said first end to said driving rod by a pivotal connecting means;

a control arm adapted for connection to an oscillating spout, said control arm including a longitudinal axis; and universal joint means pivotably connecting a first end of said control arm to said second end of said intermediate lever arm and defining an angle of alignment between said control arm and said lever arm, said universal joint means being pivotably connected to said longitudinal axis of said control arm;

said universal joint means including means to offset said angle of alignment between said control arm and said lever arm wherein said angle is less than 180 degrees when said control arm is vertically aligned with said driving rod, said offset means being located on said universal joint means in a position which is laterally offset from said longitudinal axis of said control arm.

2. The apparatus of claim 1 wherein said universal joint means comprises:

a connecting block journaled on a first axis to said intermediate lever; and said connecting block having a bore with a second axis;

said first end of said control arm being rotationally mounted; and the second axes of said bore and said first axis being orthogonal and offset in relation to each other.

3. Apparatus for driving and controlling the movement of an oscillating spout capable of movement about two orthogonal axes under the direction of a control arm having the same degrees of freedom of movement as the spout comprising:

a driving rod capable of rotation about its longitudinal axis and capable of axial displacement;

an intermediate lever arm having an axis and having a first end and a second end and being connected at said first end to said driving rod by a pivotable connecting means;

a control arm having an axis and being adapted for connection to an oscillating spout to effect movement of the spout corresponding to movement of said control arm, said intermediate lever arm axis and said control arm axis defining axes having angles of inclination therebetween;

universal joint means connecting a first end of said control arm to said second end of said intermediate lever arm and defining an angle of alignment between said control arm and said lever arm;

longitudinal displacement of said driving rod causing corresponding changes in the angles of inclination of said axes of said intermediate lever arm and said control arm relative to the longitudinal axis of the driving rod and rotation of said driving rod causing a conical precession movement of said control arm about said longitudinal axis; and said universal joint means including means to offset said angle of alignment between said control arm and said lever arm wherein said angle is less than 180° when said control arm is vertically aligned with said driving rod, said offset means being located on said universal joint means in a position which is laterally offset from said longitudinal axis of said control arm.

4. The apparatus of claim 3 wherein said universal joint means comprises:

a connecting block journaled on a first axis to said intermediate lever; and said connecting block having a bore with a second axis;

said first end of said control arm being rotationally mounted; and the second axes of said bore and said first axis being orthogonal and offset in relation to each other.

5. Apparatus for controlling the movement of an oscillating spout comprising:

a driving rod capable of rotation about its longitudinal axis and capable of axial displacement;

an intermediate lever arm having a first end and a second end and connected at said first end to said driving rod by a pivotal connecting means;

a control arm adapted for connection to an oscillating spout, said control arm including a longitudinal axis;

universal joint means pivotably connecting a first end of said control arm to said second end of said intermediate lever arm and defining an angle of alignment between said control arm and said lever arm, said universal joint means being pivotably connected to said longitudinal axis of said control arm; and said universal joint means including means to prevent alignment between said lever arm and said control arm when said control arm is vertically aligned with said driving rod wherein said means to prevent alignment is locate on said universal joint means in a position which is laterally offset from said longitudinal axis of said control arm.

6. The apparatus of claim 5 wherein said universal joint means comprises:

a connecting block journaled on a first axis to said intermediate lever; and said connecting block having a bore with a second axis;

said first end of said control arm being rotationally mounted; and the second axes of said bore and said first axes being orthogonal and offset in relation to each other.

7. Apparatus for driving and controlling the movement of an oscillating spout capable of movement about two orthogonal axes under the direction of a control arm having the same degrees of freedom of movement as the spout comprising:

a driving rod capable of rotation about its longitudinal axis and capable of axial displacement;

an intermediate lever arm having an axis and having a first end and a second end and being connected at said first end to said driving rod by a pivotable connecting means;

a control arm having an axis and being adapted for connection to an oscillating spout to effect movement of said spout corresponding to movement of said control arm, said intermediate lever arm axis and said control arm axis defining axes having angles of inclination therebetween;

universal joint means connecting a first end of said control arm to said second end of said intermediate lever arm and defining an angle of alignment between said control arm and said lever arm;

longitudinal displacement of said driving rod causing corresponding changes in the angles of inclination of said axes of said intermediate lever arm and said control arm relative to the longitudinal axis of the driving rod and rotation of said driving rod causing a conical precession movement of said control arm about said longitudinal axis; and said universal joint means including means to prevent alignment between said lever arm and said control arm when said control arm is vertically aligned with said driving rod wherein said means to prevent alignment is located on said universal joint means in a position which is laterally offset from said longitudinal axis of said control arm.

8. The apparatus of claim 7 wherein said universal joint means comprises:

a connecting block journaled on a first axis to said intermediate lever; and said connecting block having a bore with a second axis;

said first end of said control arm being rotationally mounted; and the second axes of said bore and said first axis being orthogonal and offset in relation to each other.

* * * * *